US011434607B2

(12) United States Patent
Mendez-Gallon et al.

(10) Patent No.: US 11,434,607 B2
(45) Date of Patent: Sep. 6, 2022

(54) CURTAIN APPLICATION UNIT AND METHOD FOR APPLYING AN APPLICATION MEDIUM

(71) Applicant: VOITH PATENT GMBH, Heidenheim (DE)

(72) Inventors: Benjamin Mendez-Gallon, Koenigsbronn (DE); Christoph Henninger, Heidenheim (DE); Tadashi Sasa, Tokyo (JP); Toshihiro Katano, Motomiya (JP); Akio Hirano, Chiba-Ken (JP)

(73) Assignee: Voith Patent GmbH, Heidenheim (DE)

( * ) Notice: Subject to any disclaimer, the term of this patent is extended or adjusted under 35 U.S.C. 154(b) by 228 days.

(21) Appl. No.: 16/651,593

(22) PCT Filed: Oct. 2, 2018

(86) PCT No.: PCT/EP2018/076779
§ 371 (c)(1),
(2) Date: Mar. 27, 2020

(87) PCT Pub. No.: WO2019/076627
PCT Pub. Date: Apr. 25, 2019

(65) Prior Publication Data

US 2020/0256017 A1 Aug. 13, 2020

(30) Foreign Application Priority Data

Oct. 18, 2017 (DE) ..... 102017124280

(51) Int. Cl.
*D21H 23/48* (2006.01)
*B05C 5/00* (2006.01)
(Continued)

(52) U.S. Cl.
CPC ..... *D21H 23/48* (2013.01); *B05C 5/005* (2013.01); *B05C 5/008* (2013.01); *B05C 9/06* (2013.01); *B05D 1/305* (2013.01); *B05D 2252/02* (2013.01)

(58) Field of Classification Search
None
See application file for complete search history.

(56) References Cited

U.S. PATENT DOCUMENTS 3,365,325 A 1/1968 Fraenkel et al.
5,624,715 A 4/1997 Gueggi et al.
(Continued)

FOREIGN PATENT DOCUMENTS

DE 3316992 A1 11/1984
DE 102005039169 A1 3/2007
(Continued)

OTHER PUBLICATIONS

Written Opinion of the ISA (International application No. PCT /EP2018/076779).*
(Continued)

*Primary Examiner* — Jethro M. Pence
(74) *Attorney, Agent, or Firm* — Laurence A. Greenberg; Werner H. Stemer; Ralph E. Locher

(57) ABSTRACT

A curtain application unit for applying a liquid or pasty application medium to at least one surface of a moving material web, in particular a fibrous web, includes an application head having at least one separation edge extending substantially over the width of the application head. The application medium exits the application head in the form of a free-falling curtain at the separation edge. At least one rinsing device is used to apply a flowing gaseous rinsing medium to the at least one separation edge, and at least one blocking device is suitable for keeping air movements of the
(Continued)

ambient air away from the curtain. A method for coating a moving material web is also provided.

22 Claims, 9 Drawing Sheets

(51) Int. Cl.
*B05C 9/06* (2006.01)
*B05D 1/30* (2006.01)

(56) References Cited

U.S. PATENT DOCUMENTS

| | | | | |
|---|---|---|---|---|
| 5,773,093 | A * | 6/1998 | Mitani | D21H 23/48 427/420 |
| 5,885,659 | A * | 3/1999 | Takahashi | B05C 5/008 118/325 |
| 5,906,865 | A * | 5/1999 | Ellermeier | B05C 5/008 118/325 |
| 2020/0038901 | A1 | 2/2020 | Sasa et al. | |

FOREIGN PATENT DOCUMENTS

| | | | |
|---|---|---|---|
| DE | 102008040405 | A1 | 1/2010 |
| DE | 102008040419 | A1 | 1/2010 |
| DE | 102016209336 | A1 | 11/2017 |
| EP | 1142647 | A2 | 10/2001 |
| EP | 1428582 | A1 | 6/2004 |
| EP | 1538263 | A1 | 6/2005 |
| WO | 03075988 | A1 | 9/2003 |
| WO | 2004027153 | A1 | 4/2004 |
| WO | 2017207236 | A1 | 12/2017 |
| WO | 2018137932 | A1 | 8/2018 |

OTHER PUBLICATIONS

Pulkrabek et al.: "Single-Pass Curtain Coating", In: Materials and Manufacturing Processes, 8, 3, pp. 341-352, ISSN 1532-2475.

* cited by examiner

CURTAIN APPLICATION UNIT AND METHOD FOR APPLYING AN APPLICATION MEDIUM

BACKGROUND OF THE INVENTION

Field of the Invention

The invention relates to a curtain application unit for applying a liquid or pasty application medium to at least one surface of a moving material web, in particular a fibrous web, the curtain application unit including an application head having at least one separation edge extending substantially over the width of the application head and the application medium exiting the application head in the form of a free falling curtain at the separation edge. The invention also relates to a method for coating a moving material web, especially a fibrous web, with at least one liquid and/or pasty application medium by using a curtain application unit.

In the production of fibrous webs such as paper or carton webs, a coating is often applied to one or both sides of the material web in order to improve the surface properties. For this, the coating by means of a curtain application unit has become established in recent years.

Curtain application units are often used in paper or B&P manufacturing in order to achieve an especially high coating quality with low consumption of the costly coating color. Curtain application units are therefore often used to generate the uppermost, so-called top layer. Since the top layer of the paper or B&P web is the layer establishing the external appearance of the paper or carton, especially high quality requirements are placed on the top layer.

However, a high coating quality is also an important quality criterion for layers below the top layer when using such application units.

Curtain application units for the coating of a moving material web with at least one liquid and/or pasty application medium generally comprise an application head, having at least one separation edge extending basically over the width of the application head, at which the application medium exits the application head in the form of a free falling curtain.

In order to assure the most uniform possible application of the coating medium, one must prevent a disruption of the thin curtain as much as possible. Likewise, one must prevent the material web and the coating deposited on it from being damaged by other interferences, such as water of condensation at the nozzle lips or water of condensation trickling down.

Such a curtain is especially vulnerable to air currents. The curtain is especially sensitive in cases where a large curtain height is required or desired, or in the case of low flow volumes of the coating color.

Air currents are produced at many places in the neighborhood of a paper making machine.

Thus, for example, air is entrained by the material web itself, which can disrupt the curtain. Various devices for removal of the air boundary layer are known in the prior art for removal of entrained flow or air boundary layers. For example, one may mention DE 10 2008 040 419 and DE 10 2008 040 405.

However, many air currents also occur that are not induced by the moving material web. Such currents may be produced by moving parts of the machine, but also by the factory ventilation or the movements of the operating personnel. In order to keep such air currents away from the curtain, the curtain application units have been enclosed, as for example in EP 1 538 263. But such an enclosure has some drawbacks. On the one hand, the enclosure must be relatively large so that the operating personnel can have access to the application unit for monitoring and servicing. Such a large enclosure requires not only a correspondingly large space in the machine room, but also involves significant costs.

In recent time, an alternative solution has also been proposed, wherein a curtain application unit is protected not by an accessible enclosure, but instead is encapsulated by a hood in immediate proximity to the application head.

With such a solution, however, the application head is not directly accessible to operating personnel. For this, the hood must be opened or removed. When this is done during ongoing operation, the protective effect of the hood is lost.

Furthermore, fluctuations in temperature and/or humidity have an especially negative impact on a stable operation of curtain application units. Since application units are often arranged near drying devices, such as cylinder drying devices and/or infrared drying devices, such application units are often operated in an environment with high ambient temperature combined with high humidity. Moreover, vacuum degassing equipment is used to degas the coating color of curtain application units, i.e., to make sure that the coating color can emerge from the application head of the curtain application unit without any air bubbles, and this equipment must be operated at low temperature in order to prevent a boiling of the coating color. Because of the cool coating color moving in the application head, the warm ambient air may condense, especially at the separation edge of the application head, and condensation droplets may fall onto the fibrous web being produced or condensation droplets at the nozzle lip may disrupt the liquid curtain and produce stripes with little coating. In order to prevent this, curtain application units are generally operated in a surrounding enclosure or encapsulation having climate control.

A major drawback of such climate-controlled enclosures is that the climate control is very costly, both in its acquisition and in its ongoing operation.

SUMMARY OF THE INVENTION

It is the object of the present invention to find a more cost-effective alternative to a climate-controlled enclosure, by means of which a condensing of the ambient air at the application head can be reduced or prevented in the same or similar manner to a climate control, while still ensuring a stable operation of the curtain application unit.

It is another object of the invention to propose a curtain application unit in which the curtain is largely unaffected by air currents even in the case of large curtain height or low application volume of application medium.

It is another object of the invention to enable a simple servicing and monitoring of the curtain application unit, so that the curtain is unaffected or only very slightly affected by the movements of the operating personnel.

It is another object of the invention to propose a compact and flexible design for a curtain application unit in order to allow a retrofitting even during tight space conditions and for a given web guidance.

These objects are entirely achieved by a curtain application unit as described below as well as a method as described below.

A curtain application unit is proposed for applying a liquid or pasty application medium to at least one surface of a moving material web, in particular a fibrous web.

The curtain application unit comprises an application head having at least one separation edge extending substantially over the width of the application head, at which separation edge the application medium exits the application head in the form of a free falling curtain.

According to the invention, at least one rinsing device is provided, by means of which a flowing gaseous rinsing medium can be applied to at least one of the at least one separation edge.

Furthermore at least one blocking device is provided, which is suitable to keeping air movements of the ambient air away from the curtain.

The blocking device according to the invention ensures that the curtain remains for the most part unaffected by air currents even at large curtain height.

There are diverse possibilities for the design and the arrangement of the blocking device, as will be further explained below, so that the curtain application unit can be adapted to the circumstances of the installation, the running of the material web, etc., so that a servicing and monitoring of the curtain application unit is easily possible, without the curtain being significantly influenced by the movements of the operating personnel.

Because of the fact that, according to the invention, at least one rinsing device is provided, by means of which at least one of the at least one separation edge is or can be subjected to a flowing gaseous rinsing medium, little or no ambient air can collect in the area of the separation edge and condense on the separation edge.

Thanks to the combination of rinsed separation edge and blocking device, a climate control can be dispensed with entirely, or only a very simple climate control can be used.

Furthermore, it is possible thanks to the invention to do without the otherwise typically complete enclosure of the curtain application unit together with a portion of the moving material web. This greatly simplifies the construction and the installation of the curtain application unit in a coating layout, also when space conditions are tight, and furthermore significantly reduces the costs incurred. The invention also has great flexibility in regard to the possibilities for web guidance, since many of the restrictions on the web guidance due to a fixed enclosure are now eliminated.

Advantageous embodiments and modifications of the invention are indicated in the dependent claims.

Preferably, the application head comprises at least one cross distribution chamber and, connected to this, a nozzle gap having an exit opening, such that the application medium coming from the cross distribution chamber through the nozzle gap to the exit opening exits the application head at the exit opening, the at least one separation edge being formed by at least a portion of the exit opening. Specifically, in this context, the exit opening may provide a first and a second separation edge, the first separation edge being arranged in front and the second separation edge at the rear, looking in the running direction of the material web when the application head is used as intended.

In order to rinse both separation edges and to reduce or prevent a condensation of the ambient air there, one preferred development of the invention provides for a first and/or a second rinsing device, which is or are arranged such that the first rinsing device applies rinsing medium to the first separation edge in front and the second rinsing device applies rinsing medium to the second separation edge in the rear, looking in the running direction of the material web when the application head is used as intended.

In an alternative embodiment to the previous embodiments it is provided that the application head comprises at least one cross distribution chamber and, connected to this, a nozzle gap having an exit opening, as well as an adjacent sliding face which is in turn adjacent to the separation edge, such that the application medium arriving from the cross distribution chamber via the nozzle gap and the exit opening flows after the exit opening across the sliding face to the separation edge and exits the application head at the separation edge, looking in the flow direction of the application medium.

Specifically, the at least one rinsing device may be arranged outside the nozzle gap.

Preferably, the at least one rinsing device is configured and arranged such that the flow of the gaseous rinsing medium is directed toward the free falling curtain.

Specifically, the application head may comprise a housing block, especially one made of a metallic material, in which the cross distribution chamber and the nozzle gap are arranged, and the housing block is surrounded at least for a portion by an exterior cladding and/or a thermally insulating layer, which comes into contact with the surroundings.

The metallic material may be in particular a steel, especially an alloyed or non-alloyed stainless steel. The classification of steels and stainless steels will be found in DIN EN 10020.

Furthermore, it may be provided that the housing block consists entirely or only partly of the metallic material, especially the steel. But a fraction of more than 90 wt. % may be advantageous.

The exterior cladding may be provided by or may comprise, at least partially for example, at least one flat and/or curved metal sheet, or at least one flat and/or curved plastic plate such as a plexiglass plate.

According to a specific embodiment, the exterior cladding may be thermally decoupled at least for a portion by the thermally insulating layer from the housing block. In this case, the thermally insulating layer is arranged at least for a portion between the exterior cladding and the housing block. Thanks to the exterior cladding thermally decoupled from the housing block, the ambient air does not come into direct contact with the "cool" housing block, through which the application medium is channeled.

This has the benefit, on the one hand, that the risk of condensation on the housing block is reduced. On the other hand, a heating of the housing block by warmer ambient air is prevented, so that no deforming of the housing block can occur. Because of the high requirements on the precision, for example that of the nozzle gap, even slight deformations here may have a major impact on the quality of the coating. Such a nozzle insulation makes it possible to keep constant the profile quality of the coating in the CD direction.

According to another alternative embodiment of the invention, the exterior cladding may also be formed at least for a portion by a thermally insulating layer.

Experiments of the applicant have shown that a very stable operation of the curtain application unit can be achieved in particular by the combination of a thermal insulation—at least partially—of the housing block with the rinsing of at least one separation edge with a gaseous rinsing medium such as air.

Various possibilities are conceivable for the construction of the thermally insulating layer.

According to one conceivable variant, the thermally insulating layer comprises a foam material and/or a honeycomb structure and/or glass wool and/or mineral wool or it is formed by one or more of these.

According to another conceivable variant, the thermally insulating layer is formed by a gaseous insulating medium, which is arranged or channeled in a gap between the housing block and the exterior cladding, the gap in the area of the separation edge being in particular in the range of 0.5 mm to 50 mm, preferably 2 to 10 mm. In this case, it is especially advantageous for the gaseous insulating medium to be provided at least partly, preferably entirely, by the flowing gaseous rinsing medium. In this case, an insulation of the housing block and a rinsing of the at least one separation edge can be provided in especially simple manner.

Specifically, the gaseous insulating medium and/or the gaseous rinsing medium is air in particular, and it may be provided that the air has been conditioned in terms of its temperature and/or its moisture content prior to its use as a rinsing medium and/or insulating medium.

As regards the at least one blocking device, it may be provided that at least one blocking device is arranged before or after the application head in the running direction of the material web.

In particular, two or more blocking devices may also be provided, at least one blocking device being arranged before the application head and at least one blocking device after the application head.

In another advantageous embodiment of the invention, the at least one blocking device, especially all the blocking devices, may comprise means for generating an air shield, especially one or more air nozzles.

In particular, it may be provided that the flow direction of the air of the air shield has one component pointing away from the application head and/or one component pointing away from the material web.

The blocking action of the blocking device is realized in these embodiments in that an air flow is specifically generated, yet directed such that it does not interfere with the curtain. The air flow of the air shield should be strong enough so that the air movements of the ambient air, which are produced for example by the movement of the operating personnel, do not make it through the air shield, or are greatly weakened.

In order to accomplish the largest possible blocking action, the air shield will often extend at least over the width of the material web, or the width of the curtain, or even slightly beyond.

Since the required air volumes and velocities may differ greatly according to the installation or operating conditions, means may be provided in especially advantageous embodiments for controlling or regulating the air volume and/or air velocity. Hence, the operator has the ability to adjust the air shield optimally. The air volumes may advantageously be in the range of 0.2 $m^3$/min/m to 12 $m^3$/min/m. Especially preferably, the air volumes may be between 0.5 $m^3$/min/m and 0.9 $m^3$/min/m. Alternatively, the air volumes may also be over 1.2 $m^3$/min/m, especially between 2.4 and 9 $m^3$/min/m.

Unless otherwise specifically mentioned, the figures for the air volume are measured at 20° C. and 1 bar pressure.

Another major benefit of this air shield is that the operating personnel can easily switch off the air shield for maintenance and repair work, or they can also simply reach through the air shield. Thus, there is no costly disassembly of a firmly installed rigid device.

Thus, for example, a suitable sample holder or catching vessel for taking samples of application medium from the curtain can be led through to the curtain. Neither the application process needs to be interrupted nor the air shield switched off for this purpose.

In an especially advantageous embodiment, it may be provided that the distance between the blocking device and the application head is less than 150 cm, especially less than 100 cm, especially preferably less than 50 cm.

This can reduce the risk, for example, of generating air movements in the space between the blocking mechanism and the curtain application unit, which might have disruptive effect on the curtain.

In particular, such a close arrangement can prevent operating personnel from staying between the blocking device and the curtain application unit during the operation.

For example, with distances of 50 cm or less, it is possible for the operating personnel of the machine to reach through the air shield and perform work on the nozzle or the curtain, such as taking samples. This allows the operating personnel to work easily, without their movements or the air currents generated by them interfering with the operation.

It may also prove to be advantageous to arrange the air shield not too close to the application head. Preferably, a distance of 20 cm or more, especially 25 cm or 30 cm or more can be chosen. Such a positioning on the one hand makes it easier to mount the air nozzles. On the other hand, this also prevents a suction from being generated by the ascending air of the air shield, which may then interfere with the curtain.

If air is used as the rinsing medium and if at least one blocking device is realized by means of an air shield, it may be advantageously provided that the rinsing device and the at least one blocking device are connected to a common air supply. In particular, the common air supply can be a central compressed air supply, which is usually present any way in the factory building.

Such a common air supply primarily reduces the investment costs of the layout.

As an alternative to the central compressed air supply, however, fans or compressors may also be used for example as air pressure generators for the air shield and/or the rinsing devices. It is possible to use nonconditioned air, which is for example taken directly from the surroundings of the curtain application unit. However, devices for conditioning the air may also be provided, especially for adapting its temperature and humidity.

In further advantageous embodiments, it may be provided that the rinsing device or rinsing devices are operated with air of higher air pressure than the air shield or shields. In particular, rinsing devices can be operated by means of the central compressed air supply, while the air shield is generated by a fan or compressor.

Fans are especially advantageous for generating the air shield, since they are efficient and cost-effective. The nozzles which are used with compressors usually have wide slot gaps of less than 0.8 mm. The air nozzles which are operated with fans to generate air shields usually have wide slot gaps of less than 3 mm. Air nozzles with compressors work at high static pressures (<10 bar). Air nozzles with fans usually work at low static pressures (<1 bar).

This may also be ergonomically advantageous, besides having economic benefits due to less air consumption, since less noise is also generated by the air shield, for example.

Even if the rinsing devices and the air shields are operated with different compressed air generators, it may be advantageous for them to be connectable to the same compressed air generator. Thus, for example, it may be advantageous for the air shield to also be connectable to the central compressed air supply that also supplies the rinsing devices in event of an outage of the fan or compressor, so that the operation can continue without complications. The connecting can be realized, for example, by a shutoff cock or the like. But it may also be provided that a hose connection, for example, needs to be rearranged. Importantly, the connection can be made quickly without major design measures.

Preferably, the curtain application unit has means for setting the temperature of the rinsing medium and/or that of the application medium. It is advantageous for the temperature of the rinsing medium to be between ambient temperature and the temperature of the application medium or even below the temperature of the application medium or below the temperature of the ambient air.

The means are designed in particular to set the temperature of the rinsing medium in the range of 0.4 times to 1.5 times, preferably 0.6 times to 1.5 times, the ambient temperature and/or that of the application medium. These multiples refer to the temperature value in ° C. A typical temperature of the application medium may be 30° C. Thus, it is advantageous for the means to be designed such as to set the temperature of the rinsing medium, especially the rinsing air, in the range of 0.4*30° C.=12° C. and 1.5*30° C.=45° C.

The means for setting or attuning the temperature of the rinsing medium and/or the temperature of the application medium may comprise in particular heating and/or cooling devices and temperature measuring devices by means of which the temperature of the rinsing medium and the application medium can be measured and set respectively at a target value. Preferably, said means moreover comprise a control and/or regulating device, with which the heating and/or cooling devices can be automatically regulated and/or controlled on the basis of the measured temperatures of the rinsing medium and the application medium as well as the target temperatures for the rinsing medium and the application medium.

Preferably, the curtain application unit comprises means for dehumidifying the rinsing medium or reducing the moisture content of the rinsing medium. Various direct or indirect means can be provided for this purpose.

Thus, for example, a dehumidifying device may be provided, which is directly associated with the curtain application unit, especially the rinsing device.

However, in other embodiments it may also be provided that the rinsing medium is air, which is taken from the compressed air system of the factory or production hall. This air is usually already conditioned to a certain humidity and temperature. Depending on the application, this dehumidification of the air already performed for the compressed air system of the factory may already be sufficient. In this case, the means for dehumidification of the compressed air can be considered as indirect means for dehumidification of the curtain application unit.

Furthermore, it may advantageously be provided that the curtain application unit comprises means, especially sensors, for determining the temperature of the application medium and/or the temperature of the rinsing medium and/or the relative humidity of the rinsing medium.

In particular, it is possible thanks to the invention that the curtain application unit has no enclosure. In this case, an especially compact design and a very good flexibility in the guidance of the material web are possible.

Alternatively, it is conceivable that the curtain application unit has an enclosure, but the enclosure is not climate-controlled.

By doing without a climate control, significant costs can be saved both in the installation and in the operation.

In certain of the present instances, the enclosure is designed in particular so as to surround at least the application head and the area where the curtain of application medium meets the fibrous web.

It may be provided that such an enclosure is not completely closed, and is open for example only on top or at one side. This is easily possible, since the enclosure is not climate-controlled.

Furthermore, it may advantageously be provided that the distance between the opening and the material web is at least 100 mm. In many preferred applications, the distance may be between 120 mm and 180 mm. Yet distances of more than 200 mm, or more than 300 mm, may also occur. In such an embodiment, the fall height of the curtain during the curtain application is relatively very large. The curtain here is also very susceptible to interferences, especially air movements of the ambient air. The invention can be used advantageously in such an embodiment.

In an alternative or additional variant to the preceding embodiments, it may be provided for example that the at least one blocking device comprises a plate, which is secured at or in immediate proximity to the application head, and extending substantially parallel to the curtain. Such a plate may be arranged before or after the curtain, looking in the running direction of the material web. In another especially preferred embodiment, yet another plate can also be provided, which is secured at or in immediate proximity to the application head. In this case, the one plate is often provided before, and the further plate after the curtain.

In particular, it may be provided that one or more of these plates is provided at a distance from the curtain of less than 100 mm, preferably less than 50 mm.

In this embodiment of the invention, an extremely compact design of the curtain application unit is possible.

Furthermore, the curtain application unit may also comprise a stripping device which is suitable for keeping entrained air carried along with the material web away from the curtain. Such a stripping device can typically be arranged in front of the application head, looking in the running direction of the material web. Suitable stripping devices are so-called air knifes, for example, known in the industry as air-cuts. As an alternative to this—or also in addition—

Often the stripping device ends just before the point of impact on the curtain. Unlike the blocking device, this stripping device only acts on the air boundary layer in direct proximity to the moving material web and is not suitable for keeping air movements of the ambient air, caused for example by the movement of the operating personnel or by rotating machine parts, away from the curtain.

Preferably, the exterior cladding is arranged and configured, at least in the area of the separation edge, so that it does not affect the free fall of the curtain.

According to another specific embodiment of the invention, the housing block comprises a first and a second housing block part, and the cross distribution chamber and the nozzle gap are formed by a cavity formed between the two housing block parts. In this regard, the two housing block parts are joined together in particular by connection means, especially screws.

Moreover, it is especially advisable for the first housing block part to comprise a first nozzle lip, providing the first separation edge, and for the second housing block part to comprise a second nozzle lip, providing the second separation edge, which can be adjusted relative to each other so that the width of the nozzle gap is individually adjustable in the area of the exit opening in the transverse direction of the application head, and thus in the transverse direction of the fibrous web. Thanks to this embodiment, the application head according to the invention can have an especially simple design with an adjustable nozzle gap.

According to another preferred specific embodiment of the invention, the application head has a top and a bottom and the exit opening is arranged at the bottom. In this case, it is especially advisable for the rinsing medium at least partly providing the insulating medium to flow in a direction from the top to the bottom, especially from the top to the bottom, to the area of the separation edge.

The conditioned rinsing medium (such as air) should have a suitable humidity and a suitable temperature, so that the formation of water of condensation for example on the lips of the application head or its separation edge can be reliably prevented or eliminated.

Regarding the method, the problem is solved by a method for coating a moving material web with at least one liquid and/or pasty application medium by means of a curtain application unit, especially a curtain application unit according to one aspect of the invention.

The method is characterized in that the application medium exits the application head in the form of a free falling single or multilayered curtain which then meets the material web, and a flowing gaseous rinsing medium is applied to the area of at least one of the at least one separation edge Advantageous embodiments of the method are described in the dependent claims.

Basically all of the above described blocking devices may be suitable for use in methods according to one aspect of the invention.

For example, it may be advantageously provided that the curtain application unit comprises a blocking device, which in turn comprises means for generating an air shield. Said means may be, in particular, one or more air nozzles. The velocity of the air of the air shield in especially advantageous embodiments may be between 10 m/s and 60 m/s, especially between 20 m/s and 50 m/s.

Advantageous air volumes may be in the range of 0.2 $m^3$/min/m to 1.2 $m^3$/min/m. In particular, the air volumes may be between 0.5 $m^3$/min/m and 0.9 $m^3$/min/m.

However, even larger air volumes may also be advantageous. Thus, for example, experiments of the applicant have shown that air volumes over 1.2 $m^3$/min/m, especially between 2.4 and 12 $m^3$/min/m, produce very advantageous results and stable air shields.

Advantageously, the air shield may be generated by a slot nozzle, having a slot width between 1 mm and 5 mm, especially between 2 mm and 4 mm.

For example, the following table shows several advantageous air volumes and velocities which can be generated by means of a slot nozzle. (All values given for a width of 1 m).

| | | | | | |
|---|---|---|---|---|---|
| Slot width [mm] | 2 | 2 | 3 | 4 | 5 |
| Air velocity [m/s] | 20 | 50 | 40 | 30 | 40 |
| Air volume [$m^3$/min] | 2.4 | 6 | 7.2 | 7.2 | 12 |

The values in the table above are only meant to illustrate the invention, but in no way constitute a limitation.

Depending on the application, it may also be provided that the air used for the air shield is conditioned. The conditioning may involve, for example, a filtering and/or a dehumidification and/or a heating or cooling.

An advantageous embodiment of the method is characterized in that the application medium is applied by the application head with a flow rate of less than 10 l/min*m, especially less than 6 l/min*m, especially preferably between 2 l/min*m and 5 l/min*m. In this way, a relatively thin curtain is generated, which can be influenced especially easily by air movements of the ambient air. The use of a curtain application device with a blocking device according to the invention is especially advantageous here. Especially also when the fall height of the curtain is more than 100 mm, more than 200 mm, or also 300 mm or more.

But it may also be advantageous for the application medium to be applied with a larger flow rate, such as 20 l/min*m, 25 l/min*m or more. In this way, application rates of 20 g/$m^2$ or even 30 g/$m^2$ may also be realized In another advantageous embodiment of the method, it may be provided that the material web is moved with a velocity between 100 m/min and 1200 m/min, especially between 200 m/min and 800 m/min. In order to also realize low application rates per unit of area at these velocities, the composition and/or thickness of the curtain must be adapted accordingly, which in turn also makes the curtain more susceptible to ambient air. Once again, the use of a curtain application device with a blocking device according to the invention is especially advantageous. However, the method may also be used advantageously with velocities of over 800 m/min, such as 1000 m/min, 1200 m/min, 1500 m/min or more.

Reference is made to the following Table 1 for the significance of the flow rate. As an example for a coating color as the application medium with a typical solid content of 63% the required flow rates are indicated as a function of the production rate and the desired coating weight.

TABLE 1

| Flow rates in 1/min/m | | | | |
|---|---|---|---|---|
| | Coating weight | | | |
| Production rate. | 8 g/$m^2$ | 10 g/$m^2$ | 12 g/$m^2$ | 14 g/$m^2$ |
| 200 m/min | 1.7 | 2.1 | 2.5 | 3.0 |
| 300 m/min | 2.5 | 3.2 | 3.8 | 4.4 |
| 400 m/min | 3.4 | 4.2 | 5.1 | 5.9 |
| 500 m/min | 4.2 | 5.3 | 6.3 | 7.4 |
| 600 m/min | 5.1 | 6.3 | 7.6 | 8.9 |

It can be clearly seen from Table 1 that it is very important for a broad range of applications to be able to realize an application of low flow rates in stable manner. The invention is very advantageous for the embodiments shown in Table 1, among others, especially but not exclusively in combination with a height of the curtain of 100 mm or more.

The coating weights shown here of between 8 g/$m^2$ and 14 g/$m^2$ are quite customary. However, coating weights of up to 20 g/$m^2$ or more can also be realized with the method according to the invention and the device according to the invention, respectively.

The gaseous rinsing medium can be air, in particular.

When speaking of a rinsing medium in the further description of this method, it always means the gaseous rinsing medium, unless explicitly stated otherwise.

The rinsing medium (such as air) should have a suitable humidity and a suitable temperature, so that the formation of water of condensation for example on the lips of the application head or its separation edge can be reliably prevented or eliminated.

In general, the temperature of the rinsing medium can be less than, greater than, or the same as the temperature of the application medium.

A preferred embodiment of the method provides for the temperature of the rinsing medium to be held between ambient temperature and the temperature of the application medium.

An alternative, advantageous embodiment of the method provides for the temperature of the rinsing medium to be slightly, for example less than 10° K., especially 7° K. or 5° K., below the temperature of the application medium and/or below the temperature of the ambient air.

In this context in particular, it is conceivable for the temperature of the rinsing medium to be in the range of 8° C. to 55° C., preferably 18° C. to 40° C., that of the application medium to be in the range of 18° C. to 40° C., preferably 25° C. to 35° C., and the ambient temperature to be less than 65° C.

Preferably, the temperature of the rinsing medium deviates by up to 7° K., especially preferably by at most 5° K., upward or downward, from the temperature of the application medium.

In especially preferred embodiments of the method, it may be provided that the temperature of the rinsing medium is greater than the temperature of the application medium. In particular, the temperature of the rinsing medium can be between 4° K. and 25° K., especially between 7° K. and 15° K., greater than the temperature of the application medium.

In order to prevent unwanted condensation, especially at the separation edge, it may be advantageously provided that the relative humidity of the rinsing medium is less than 100 RH %. Especially advantageously, it may be provided that the relative humidity of the rinsing medium is less than 80% RH or less than 70% RH.

It is most particularly advantageous also to prevent condensation, for the temperature and the moisture content of the rinsing medium and the temperature of the application medium to be attuned to each other.

In many cases, the temperature of the housing block will correspond substantially to the temperature of the application medium. (Possibly with a difference of 1° K., 2° K. or at most 5° K.). The separation edge will then take on the same temperature.

In applications where the temperature of the rinsing medium, such as rinsing air, is higher than that of the application medium, the rinsing medium will be cooled down in the direction of the temperature of the application medium upon flowing towards the separation edge or the other parts of the housing block. In this way, the relative humidity of the rinsing medium increases. If the temperature of the rinsing medium falls below the dew point, unwanted condensation may occur.

This circumstance can be taken into account in advantageous embodiments by keeping the moisture content of the rinsing medium low—possibly by an upstream dehumidification—such that this condensation is prevented on the nozzle lips and/or the separation edges.

In particular, it may be provided that the temperature of the rinsing medium is higher than the temperature of the application medium, and the moisture content of the rinsing medium is set such that the dew point of the rinsing medium is above the temperature of the application medium, especially more than 2° K. above the temperature of the application medium.

The relative humidity of the rinsing medium then remains so far below 100% RH, such as 80% RH, 70% RH or less, even after cooling down at the separation edge, that no condensation occurs at the nozzle lips or at the separation edge.

In order to achieve an effective rinsing of the separation edge and also ensure a stable curtain at the same time, it may be advantageously provided that the outflow velocity of the rinsing medium is between 6 m/min and 40 m/min, especially between 12 m/min and 20 m/min.

In addition or alternatively, it may also be provided that the exit velocity of the application medium from the application head is between 10 m/min and 200 m/min, especially between 16 m/min and 66 m/min.

Similar to the temperature and humidity, once again major benefits are achieved if the outflow velocity of the rinsing medium and the exit velocity of the application medium are attuned to each other.

In particular, it may be provided that the outflow velocity of the rinsing medium is between 40% and 140%, especially between 50% and 100% of the exit velocity of the application medium.

Usually, it is more advantageous for the stability of the curtain when the outflow velocity of the rinsing medium is less than or at most the same as the exit velocity of the application medium.

The following table provides yet another overview of the advantageous ranges of some process parameters as well as some exemplary possibilities of realizations of such methods. The parameter values have been determined in particular for an embodiment by means of a curtain application unit comprising a blocking device having means for generating an air shield.

TABLE 2

Possible process parameters

| Parameter | Preferred | Especially preferred | Example 1 | Example 2 |
|---|---|---|---|---|
| Web velocity [m/min] | >100 | 100-1500 | 200 | 800 |
| Solid content of application medium | 1%-72% | 55%-70% | 63% | 65% |
| Viscosity of application medium Brookfield 100 rpm [mPas] | 100-800 | 300-600 | 400 | 500 |
| Temperature of rinsing medium [° C.] | 8-55° C. | 18-40° C. | 32 | 38 |
| Temperature of application medium [° C.] | 25-35 | 30-32 | 30 | 32 |
| Rel. humidity of rinsing medium [RH %] | <100 RH % | <80 RH % | 60 RH % | 70 RH % |
| Exit velocity of rinsing medium [m/min] | 6-40 | 12-20 | 20 | 15 |
| Exit velocity of application medium [m/min] | 10-200 | 16-66 | 20 | 20 |
| Air velocity of air shield [m/s] | 15-60 | 20-50 | 33 | 27 |

It should be noted that the invention is not limited to the advantageous parameter ranges indicated in the table.

In the following, the invention will be explained more closely with the aid of schematic figures, not true to scale.

DETAILED DESCRIPTION OF THE INVENTION

Figure 1:
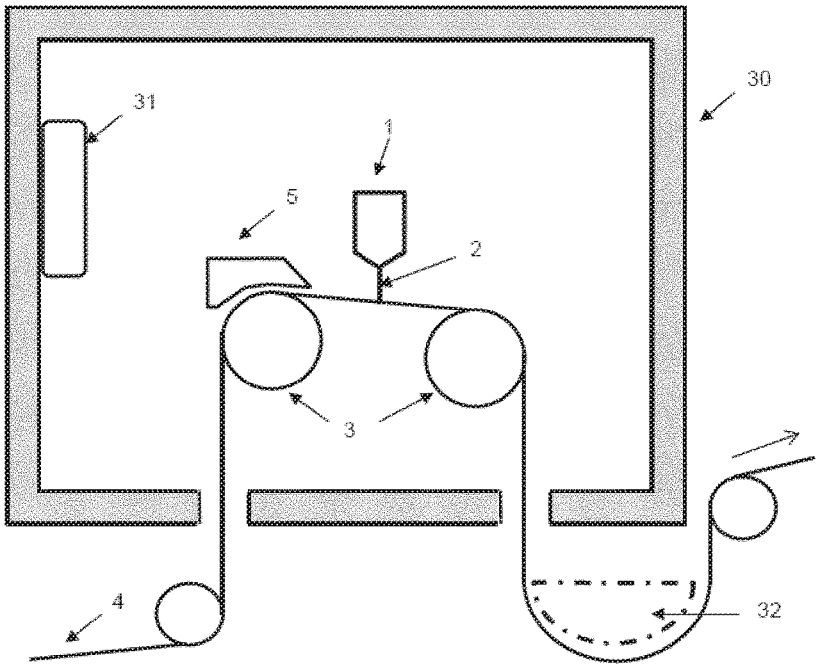
FIG. 1 shows schematically a curtain application unit of the prior art.

FIG. 1 shows a curtain application unit as is known in the prior art. Material web 4 is led through a slot into an enclosure 30. Supported by two rolls 3, it is led through beneath an application head 1, while a curtain 2 of application medium is deposited on material web 4. After the coating has been done, material web 4 is led out once more from the enclosure through another slot. In order to remove the entrained air, an air stripper 5 is provided, especially an air-cut. To prevent condensation, enclosure 30 is conditioned by means of a climate control 31. Such an encapsulated curtain application unit cannot be operated with stability without a suitable climate control. After exiting enclosure 30, material web 4 is usually deflected by a noncontact deflecting element 32, also known as an air-turn 32, and taken on for a drying, if needed.

This enclosure 30 requires a relatively large design space. Furthermore, the needed climate control entails considerable costs in its acquisition and operation.

Figure 2:
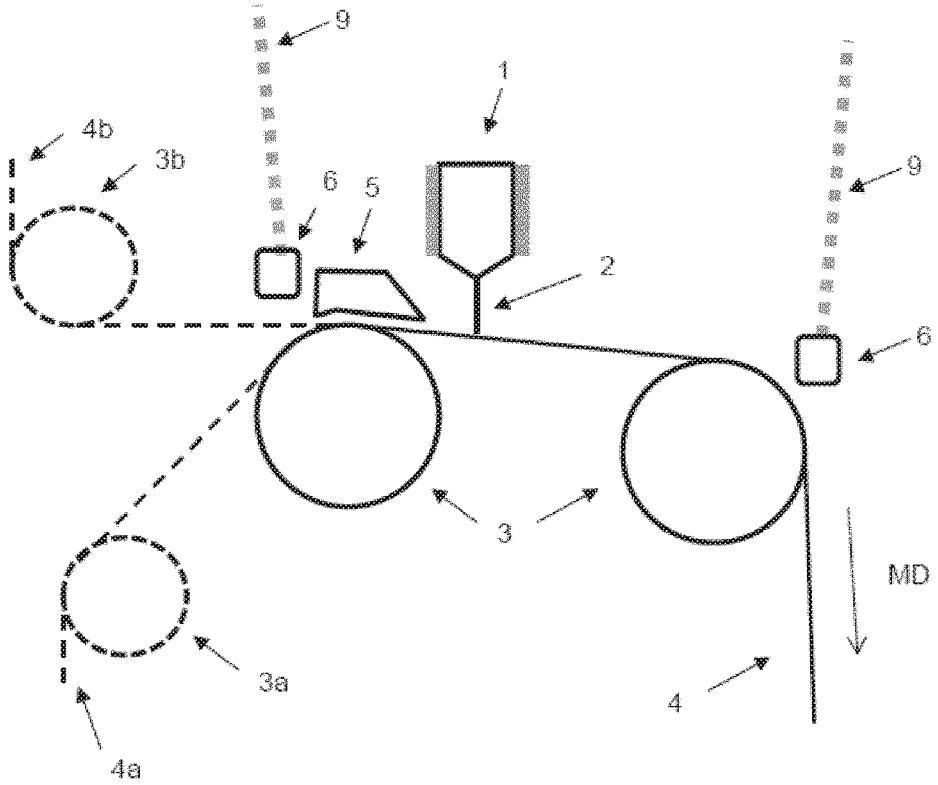
FIG. 2 shows a curtain application unit according to one aspect of the invention.

FIG. 2, on the contrary, shows a curtain application unit according to one aspect of the invention. An application head 1 is provided in the curtain application unit, from which curtain 2 is deposited on moving material web 4. Application head 1 comprises at least one rinsing device, by means of which at least one separation edge can be subjected to a flowing gaseous rinsing medium, such as air. The exterior cladding in many embodiments is at least partly thermally decoupled from the housing block by a thermally insulating layer. This is very advantageous; however, such an insulation may also be omitted.

Material web 4 moves in the machine direction MD from left to right. The application is done here by two idler rolls 3, over which the material web is led. But this is not essential to the invention. For example, the application can also be done on one roll. A stripping device 5 is provided in front of curtain 2, looking in the running direction of material web 4. This may be designed as a so-called air-cut, for example. Alternatively, it may also be provided, for example, that stripping device 5 comprises or consists of a brush, a film, or a lip, which can be placed against material web 4. Both embodiments can provide the important function of stripping device 5, namely, to reduce or remove the air boundary layer entrained by material web 4.

The curtain application unit in FIG. 2 furthermore shows two blocking devices 9, where one blocking device 9 is arranged before application head 1, and another blocking device 9 is arranged after application head 1. A respective nozzle arrangement 6 is provided. These air nozzles 6 respectively generate an air shield 9, which achieves the desired blocking action, namely, to keep air movements of the ambient air away from curtain 2. The air shield here is oriented in both blocking devices 9 so that the air flow velocity has one component which points away from application head 1 and furthermore one component which points away from material web 4. In this way, an interfering influence of the air shield on the web movement or the curtain stability can be avoided most effectively.

An enclosure of the curtain application unit is not needed here, nor is a climate control for the surroundings of the application head necessary. In this way, the acquisition costs as well as the operating costs can be reduced.

It may also be seen from FIG. 2 that the curtain application unit is very flexible, and can also be easily integrated in existing layouts. On the one hand, it may have a very compact design—especially when there is no enclosure. The curtain application unit requires only a relatively small design space in the machine transverse direction. Furthermore, it is also possible to adapt the guidance of the material web 4. In the case of an enclosed curtain application unit, the web is led into and out from the enclosure through a slot. This slot is predefined. Furthermore, it is also usually very narrow, in order to ensure an adequate climate control of the enclosure. This leads to relatively strong restrictions on the web guidance. FIG. 2 shows, as an example, that such restrictions are largely eliminated in the case of curtain application units according to the invention. The broken lines 4*a* and 4*b* show two possible runs of material web 4, 4*a*, 4*b* prior to the application process. Idler rolls 3*a* and 3*b* here can also be positioned relatively close to the application unit.

Figure 3:
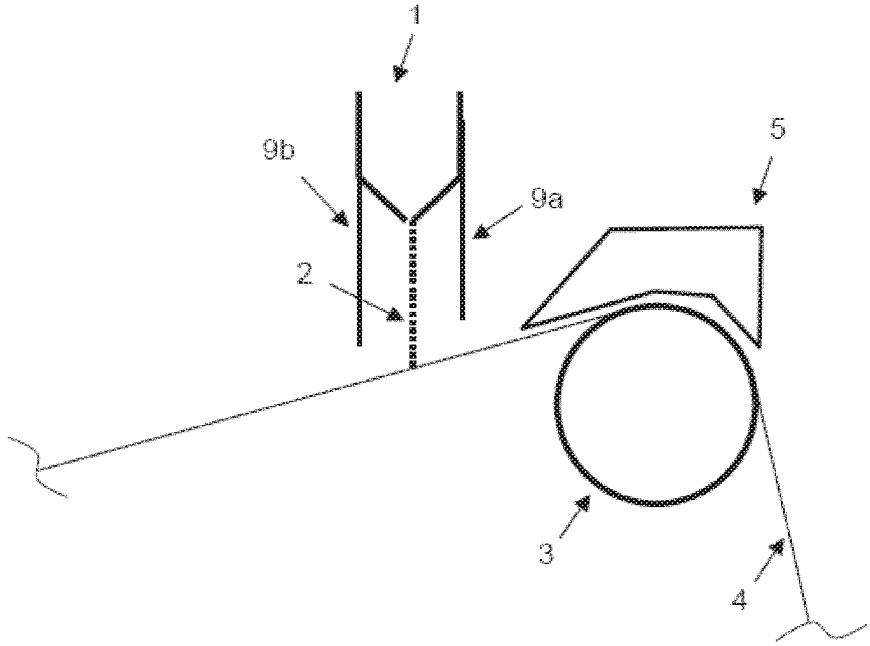
FIGS. 3 and 4 show schematically a portion of a curtain application unit according to further aspects of the invention.

The curtain application unit shown in FIG. 3 comprises an application head 1, from which a curtain 2 is deposited under the influence of gravity onto a material web 4, such as a paper or carton web. Material web 4 is diverted by means of an idler roll 3, such that its run beneath curtain 2 is largely horizontal. The point of impact of the curtain here is somewhat behind idler roll 3, looking in the running direction of material web 4. The entrained air moving along with material web 4 is kept away from curtain 2 with a stripping device 5. Suitable stripping devices 5 are so-called air knifes, for example, known in the industry as air-cuts. Often stripping device 5 ends just before the point of impact of the curtain.

In FIG. 3, the at least one blocking device 9, 9*a*, 9*b* according to the invention is realized in the form of two plates 9*a* and 9*b*. The two plates 9*a*, 9*b* here are fastened directly to the application head. While it is basically also possible for the plates to be fastened otherwise, the fastening directly to application head 1 has the benefit that the distance between plates 9*a*, 9*b* and curtain 2 is extremely short. Distances of less than 100 mm, and even less than 50 mm, can be realized here. This results in a very compact design. Moreover, the area around the application head, such as idler roll 3 or stripping device 5, is freely accessible for maintenance work or the like during operation, without interfering with curtain 2 by resulting movement of the ambient air.

Figure 4:
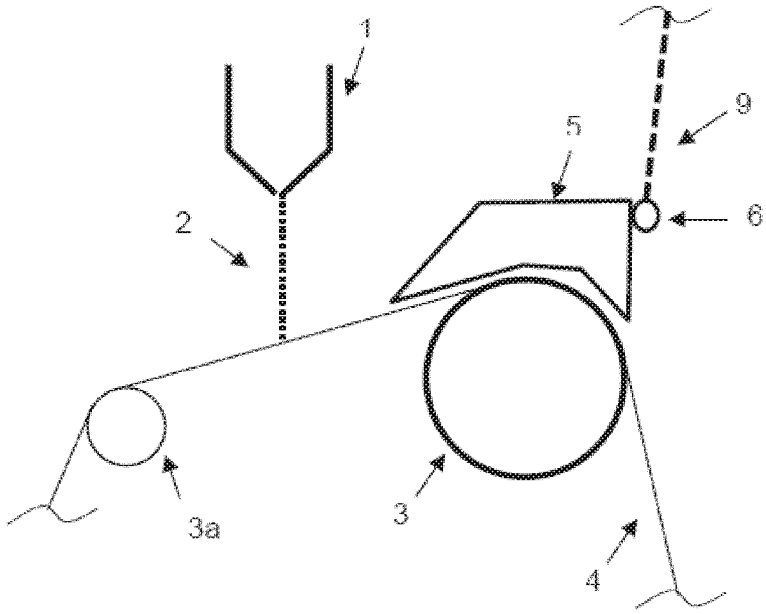

FIG. 4 shows a curtain application unit according to one preferred aspect of the invention. The at least one blocking device 9, 9*a*, 9*b* here is realized by an air shield 9. The air emerges from an air nozzle 6, or a row of nozzles 6, to generate air shield 9. The flow direction of the air, and thus the orientation of air shield 9, may be vertically upward, or also slightly slanted to this direction. Advantageously, this slanting is directed away from application head 1, and thus also away from curtain 2, in order to avoid an influencing of curtain 2 by air shield 9. Advantageously, air shield 9 may extend at least across the entire width of curtain 2 in the machine transverse direction.

In the embodiment shown in FIG. 4, air nozzle 6, or row of nozzles 6, is fastened directly to a stripping device 5. This may be advantageous, yet other possibilities of the fastening are also possible and advisable, depending on the situation.

Advantageously, the distance of the air shield from the application head is less than 150 cm, especially less than 100 cm, especially preferably less than 50 cm. As shown in FIG. 2, a further deflecting device is usually also provided after curtain 2, such as an idler roll 3*a*. The distance of this deflecting device 3*a* from the curtain 3 may vary in different installations.

Figure 5:
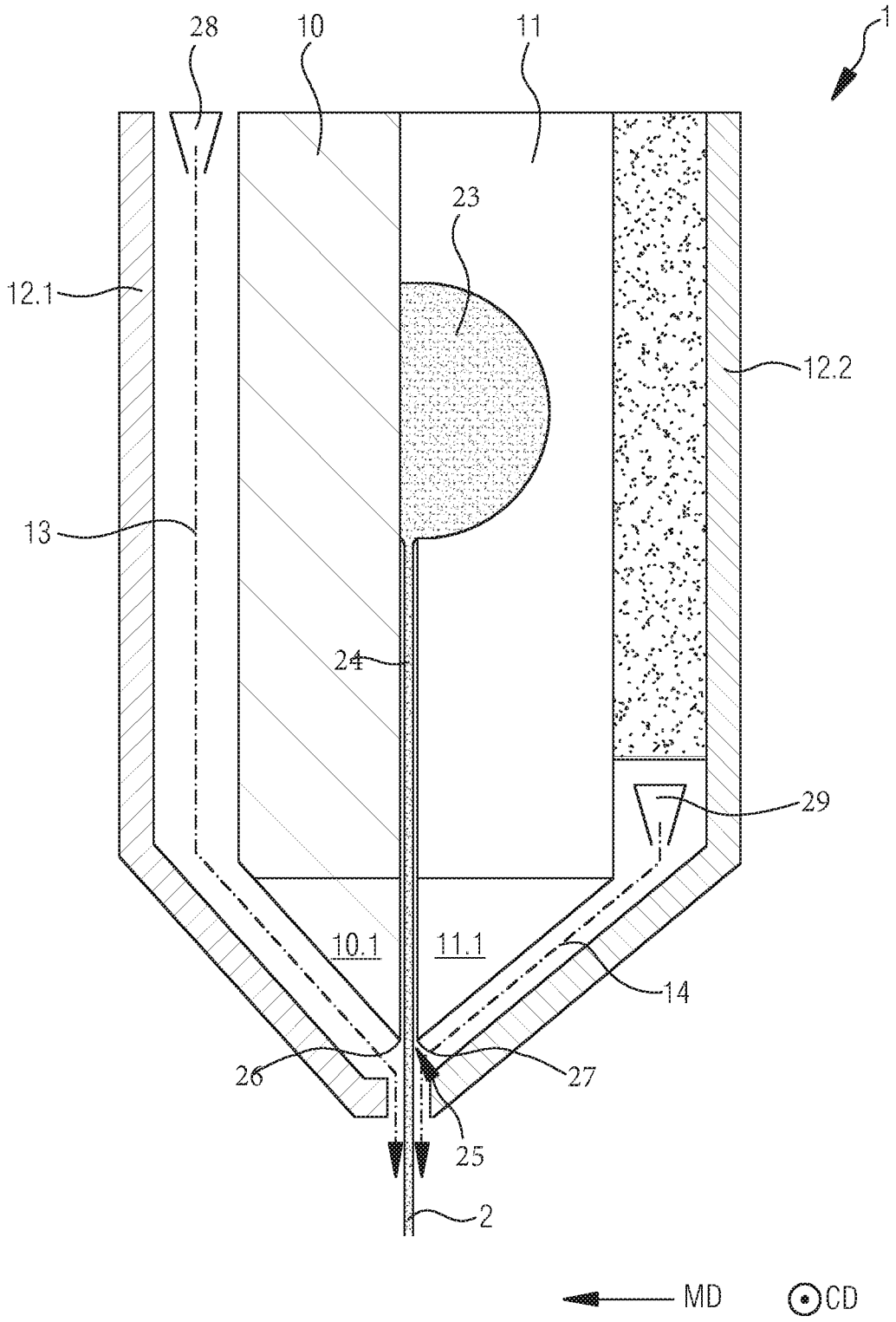
FIGS. 5 to 11 show possible realizations of an application head according to various aspects of the invention.

FIG. 5 shows—in a cross sectional representation in a plane parallel to the web running direction MD and perpendicular to the web transverse direction CD (CD extends perpendicular to the drawing layer of FIGS. 5-11)—a first embodiment of an application head 1 according to the invention for producing a single-layer free falling curtain 2 of a liquid or pasty application medium for the coating of a moving material web.

Application head 1 has a cross distribution chamber 23 and a nozzle gap 24, connected to it, with an exit opening 25, such that the application medium coming from the cross distribution chamber 23 via the nozzle gap 24 toward the exit opening 25 exits the application head 1 at the exit opening 25.

In the present case, exit opening 25 provides a front separation edge 26, looking in the web running direction MD, as well as a rear separation edge 27 looking in the web running direction MD.

As can be seen from the representation of FIG. 5, application head 1 comprises a first rinsing device 28 and a second rinsing device 29, which are arranged and configured such that, when application head 1 is used as intended, and looking in the web running direction of material web 4, first rinsing device 28 applies a flowing rinsing medium 13 (dot and dash line with arrow) to first separation edge 26 from the front and second rinsing device 29 applies a flowing rinsing medium 14 (dot and dash line with arrow) to second separation edge 27 from the rear. In the present exemplary embodiment, the two rinsing devices 28, 29 are arranged outside nozzle gap 24. In the present case, each of the two rinsing devices provides a rinsing medium in the form of air.

Application head 1 comprises a housing block made from a metallic material, advantageously a steel, in which cross distribution chamber 23 and nozzle gap 24 are arranged. The housing block comprises a first housing block part 10 (in the present embodiment, front housing block part 10) and a second housing block part 11 (in the present embodiment, rear housing block part 11), wherein cross distribution chamber 23 and nozzle gap 24 are formed by a cavity formed between the two housing block parts 10, 11. As can be seen from the representation of FIG. 5, first housing block part 10 comprises a first nozzle lip 10.1, which provides first separation edge 26 in the area of exit opening 25 of nozzle gap 24. Moreover, second housing block part 11 comprises a second nozzle lip 11.1, which provides second separation edge 27 in the area of exit opening 25 of nozzle gap 24. The two nozzle lips 10.1 and 11.1 can be moved relative to each other, so that the width of nozzle gap 24 can be individually adjusted in the area of exit opening 25 in the transverse direction of application head 1.

In the present exemplary embodiment, the housing block is surrounded for a portion by an exterior cladding 12.1, 12.2, which comes into contact with the surroundings. Exterior cladding 12.1, 12.2 here comprises a front part of the exterior cladding 12.1 in the form of a curved metal sheet, looking in the web running direction MD, and a rear part of exterior cladding 12.2 in the form of a curved metal sheet, looking in the web running direction MD. As can further be recognized, the exterior cladding 12.1, 12.2 is arranged and configured in the area of separation edges 26, 27 such that it does not affect the free fall of curtain 2.

Exterior cladding 12 is thermally decoupled from housing block 10, 11 at least for a portion by a thermally insulating layer.

In the present case, the thermally insulating layer is formed by a gaseous insulating medium between the front part of exterior cladding 12.1 and front housing block part 10, which is channeled in a gap between the front housing block part 10 and the front part of the exterior cladding 12.1 and which is provided by flowing gaseous rinsing medium 13 from first rinsing device 28. Moreover, in the present case, the upper part of the gap in FIG. 5 between rear housing block part 11 and the rear part of exterior cladding 12.2 is formed by a foam material. Moreover, one can see that the lower part of the gap in FIG. 5 between rear housing block part 11 and the rear part of the exterior cladding 12.2, adjacent to the upper part, is formed by a gaseous insulating medium, which is provided by flowing gaseous rinsing medium 14 from second rinsing device 29.

In both cases, i.e., in regard to first rinsing device 28 and second rinsing device 29, the rinsing medium flows in a direction from the top to the bottom toward the two separation edges 26, 27.

For the following discussion of FIGS. 6 to 11 it should be noted that only the differences from the explicitly mentioned embodiment (e.g., the one of FIG. 5) will be discussed and that the same or similar technical objects or features will be denoted by the same reference numbers.

Figure 6:
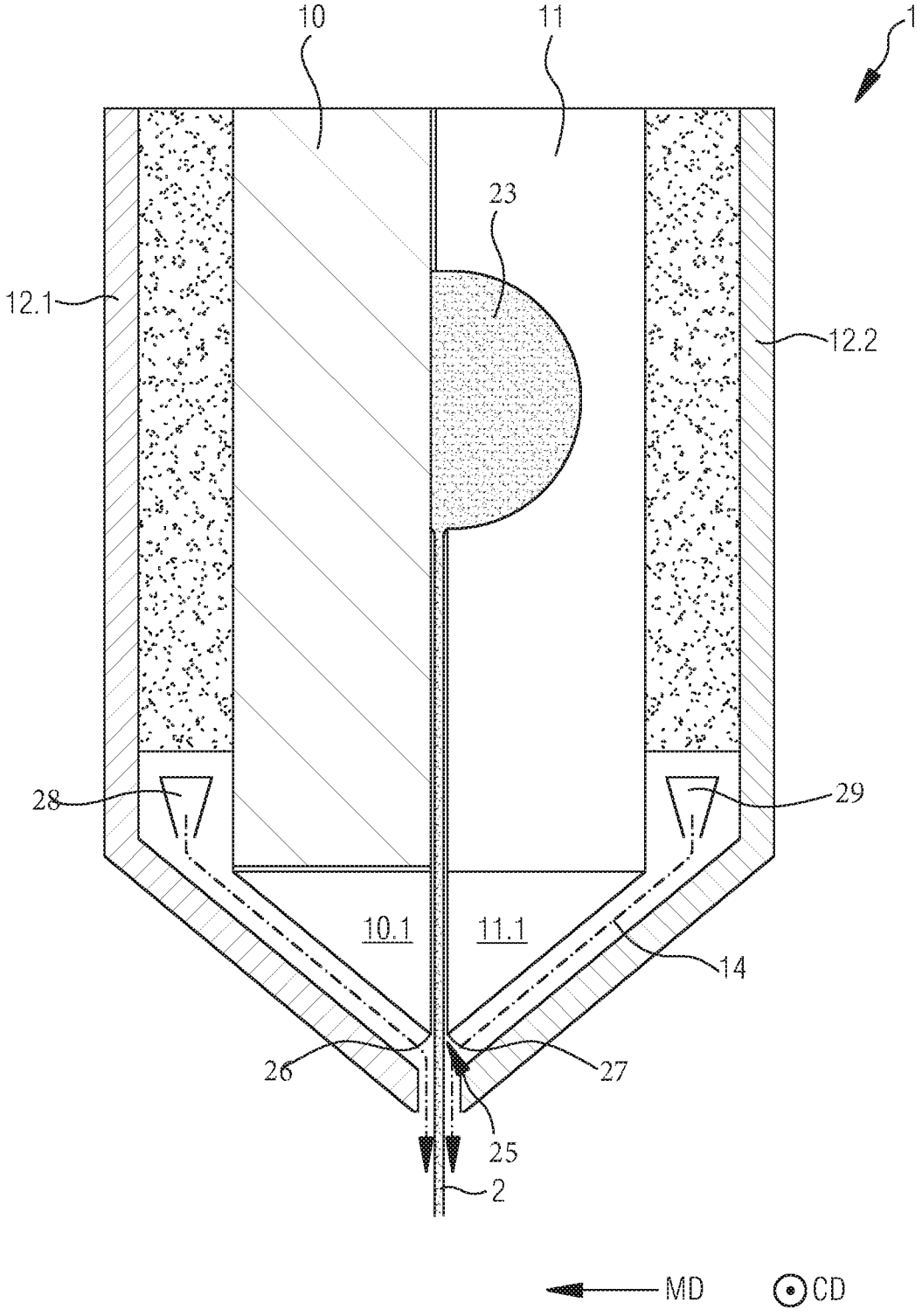

FIG. 6 shows a variant of application head 1 shown in FIG. 5. Both rinsing devices 28, 29 here are arranged in the lower area of application head 1. Both the upper part of the gap between the rear housing block part 11 and the rear part of exterior cladding, 12.2, as well as the upper part of the gap between front housing block part 10 and the front part of exterior cladding 12.1, are filled here entirely or at least partly by a foam material.

Figure 7:
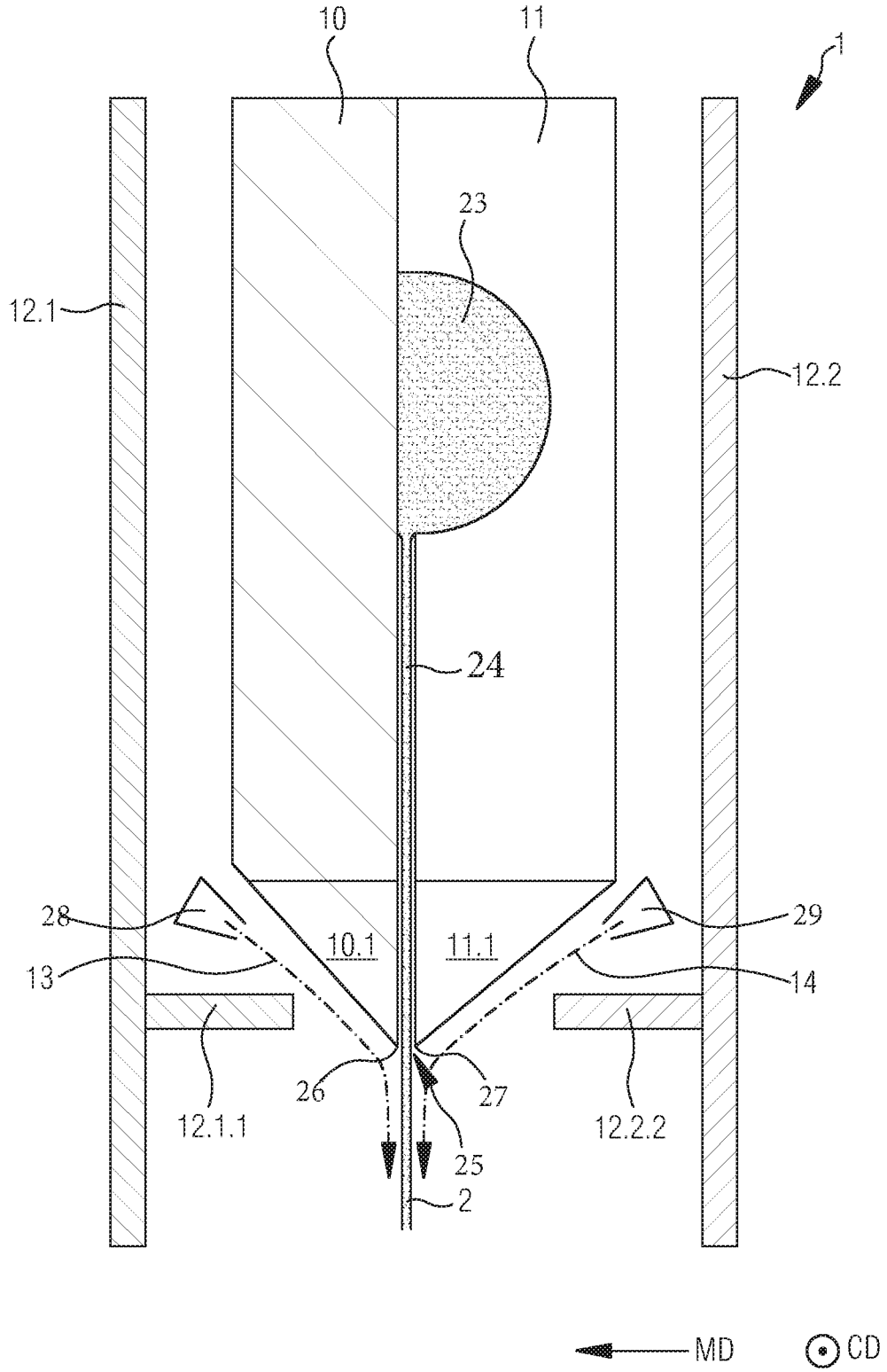

FIG. 7 shows a second embodiment of an application head 1 according to the invention for generating a single-layer free falling curtain 2.

The application head of FIG. 7 differs from the application head shown in FIG. 5 basically in that both rinsing devices 28, 29 in the application head of FIG. 7 are arranged in the lower area of application head 1, i.e., at the level of nozzle lips 10.1 and 11.1, and exterior cladding 12.1 and 12.2 in front of and behind the curtain protrude beyond the two separation edges 26, 27 at exit opening 25 by up to 100 mm in the direction of free falling curtain 2, so that free falling curtain 2 is shielded from interfering influences of the surroundings, such as air currents. For directing flowing rinsing medium 13 provided by first rinsing device 28 onto first separation edge 26, the front part of exterior cladding 12.1 comprises a baffle 12.1.1. Similarly, the rear part of exterior cladding 12.2 comprises a baffle 12.2.2, by which flowing rinsing medium 14 provided by second rinsing device 29 is directed onto second separation edge 2.

As a further difference from FIG. 5, the thermally insulating layer between the front part of exterior cladding 12.1 and housing block 10, 11 as well as the rear part of exterior cladding 12.2 and housing block 10, 11 are provided each time by air, which is not provided by rinsing medium 13, 14.

However, it may also be provided that a different thermally insulating layer instead of air, such as foam material, mineral wool, etc., can be used.

Figure 8:
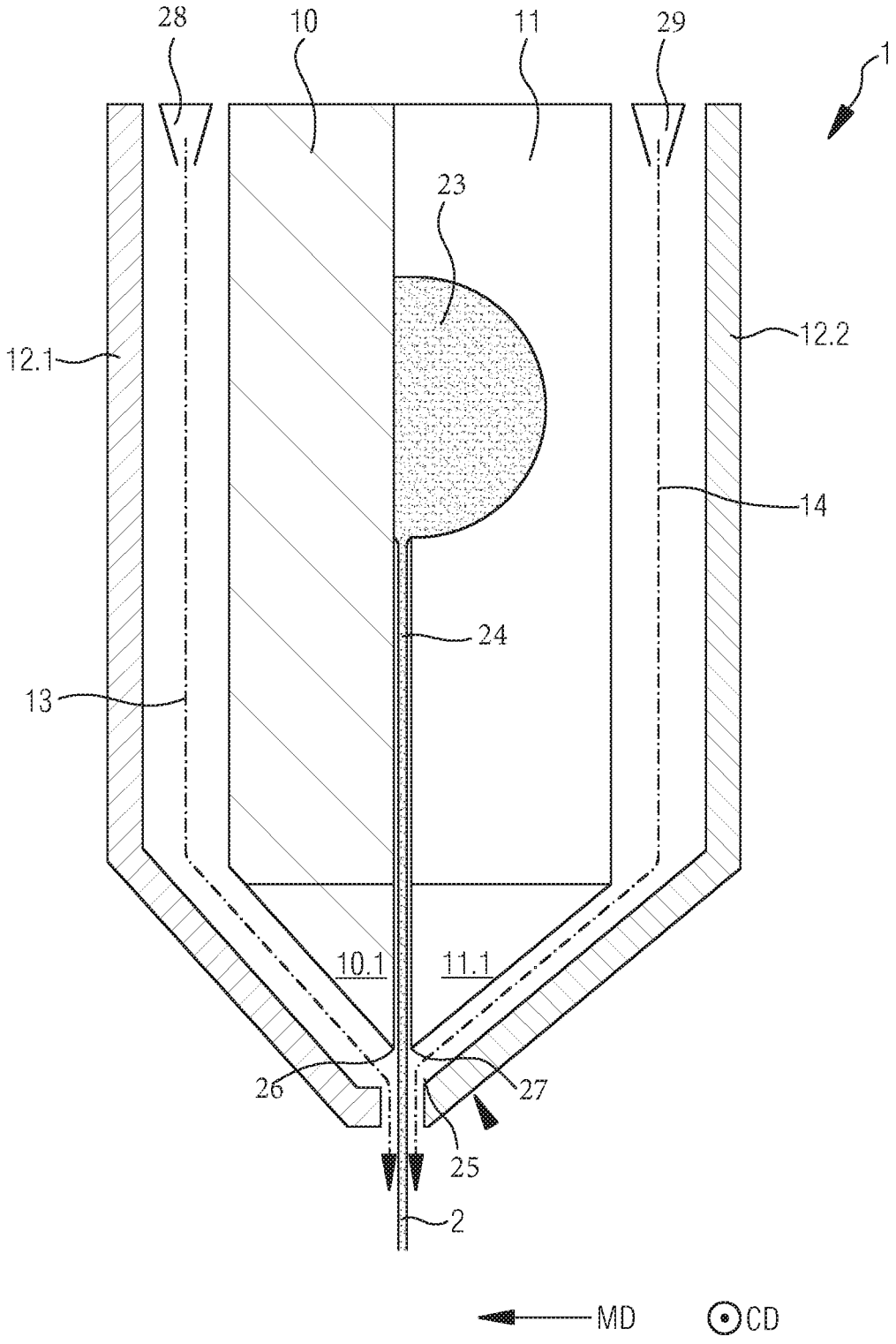

FIG. 8 shows a third embodiment of an application head 1 according to the invention for generating a single-layer free falling curtain 2.

Application head 1 of FIG. 8 differs from the application head shown in FIG. 5 basically in that the thermally insulating layer between the rear part of exterior cladding 12.2 and rear housing block part 11 is also formed by the gaseous insulating medium, which is channeled in the gap between rear housing block part 11 and the rear part of exterior cladding 12.2 and which is provided by flowing gaseous rinsing medium 14 from second rinsing device 29.

Figure 9:
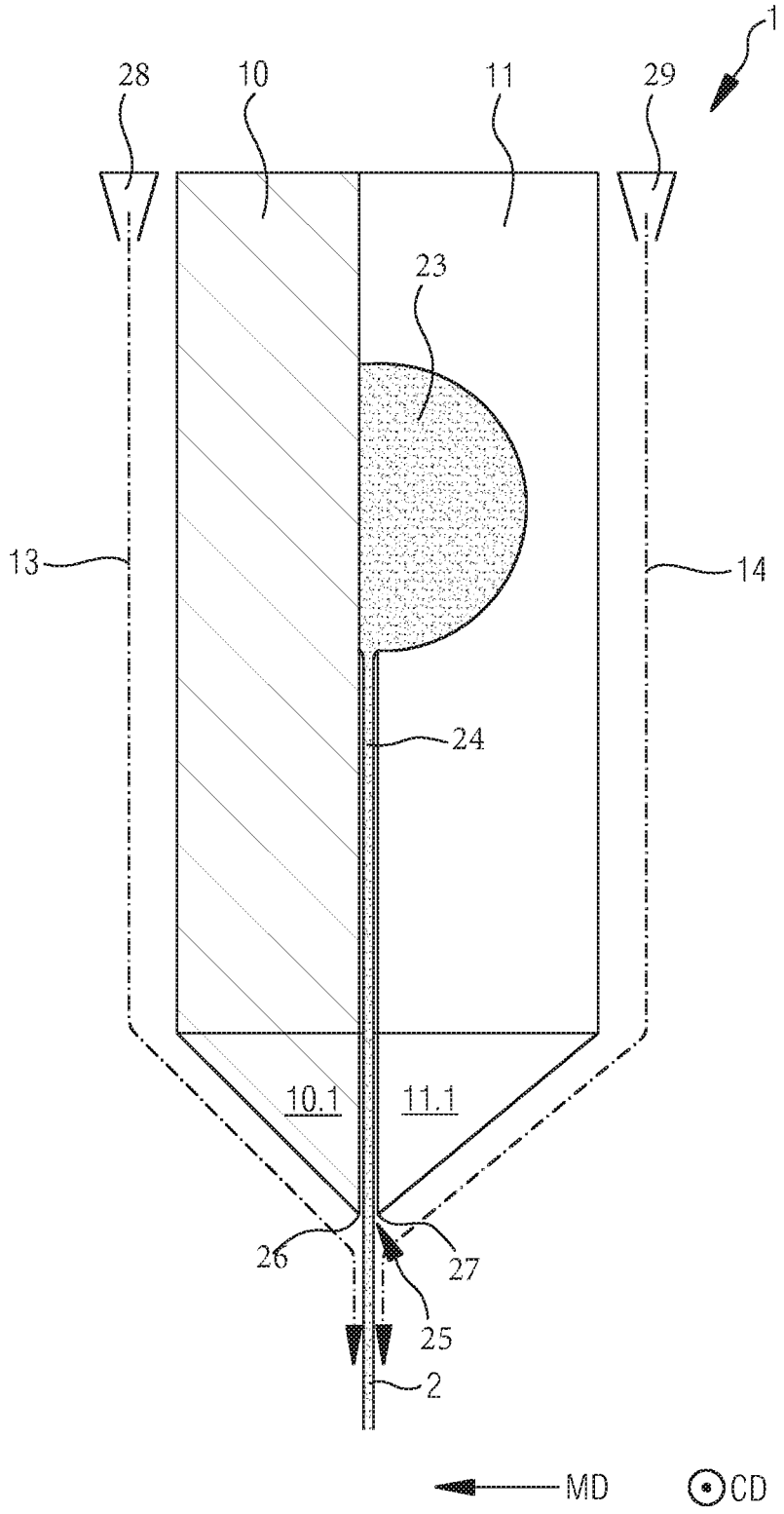

FIG. 9 shows yet another embodiment of an application head 1 according to the invention for generating a single-layer free falling curtain 2.

Application head 1 of FIG. 9 differs from the application head shown in FIG. 8 basically in that no exterior cladding 12.1 and 12.2 is provided. In the present exemplary embodiment, housing block 10, 11 is merely surrounded by the thermally insulating layer, which comes into contact with the surroundings, while the thermally insulating layer surrounding the front housing block part 10 is provided by flowing gaseous rinsing medium 13 from first rinsing device 28 and the thermally insulating layer surrounding rear housing block part 11 is provided by flowing gaseous rinsing medium 14 from second rinsing device 29.

Figure 10:
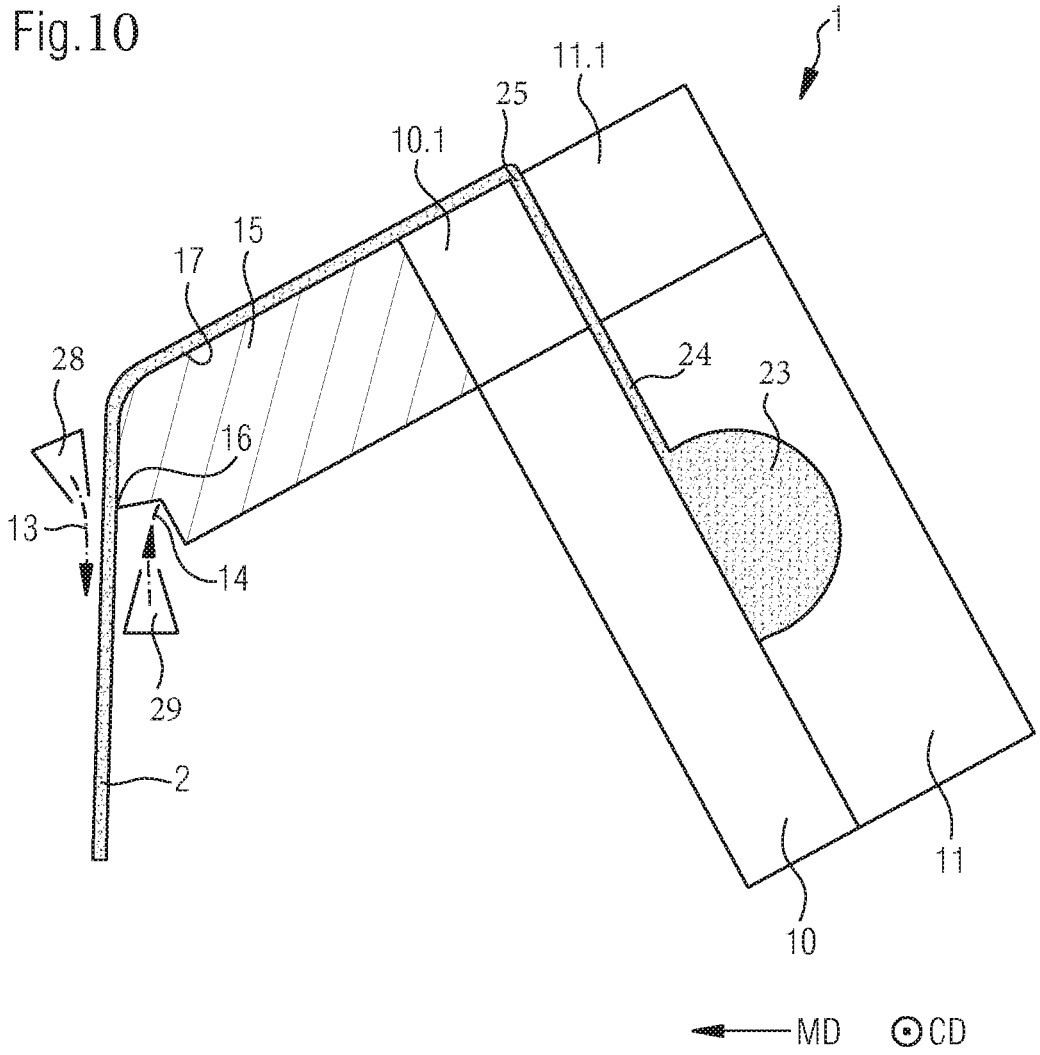

FIG. 10 shows yet another embodiment of an application head 1 according to the invention for generating a single-layer free falling curtain 2.

Application head 1 of FIG. 10 has a cross distribution chamber 23 and, connected to it, a nozzle gap 24 with an exit opening 25, as well as a sliding face 17 adjacent to it, which is in turn adjacent to a separation edge 16 such that the application medium coming from cross distribution chamber 23 via nozzle gap 24 and exit opening 25 flows after exit opening 5 across sliding face 17 toward separation edge 16 and exits application head 1 at separation edge 16. It should be mentioned that sliding face 17 is provided by a sliding face block 15 arranged at front housing block part 10.

Two rinsing devices 28, 29 are provided at separation edge 16, by means of which flowing gaseous rinsing medium 13, 14 can be applied to separation edge 16.

Figure 11:
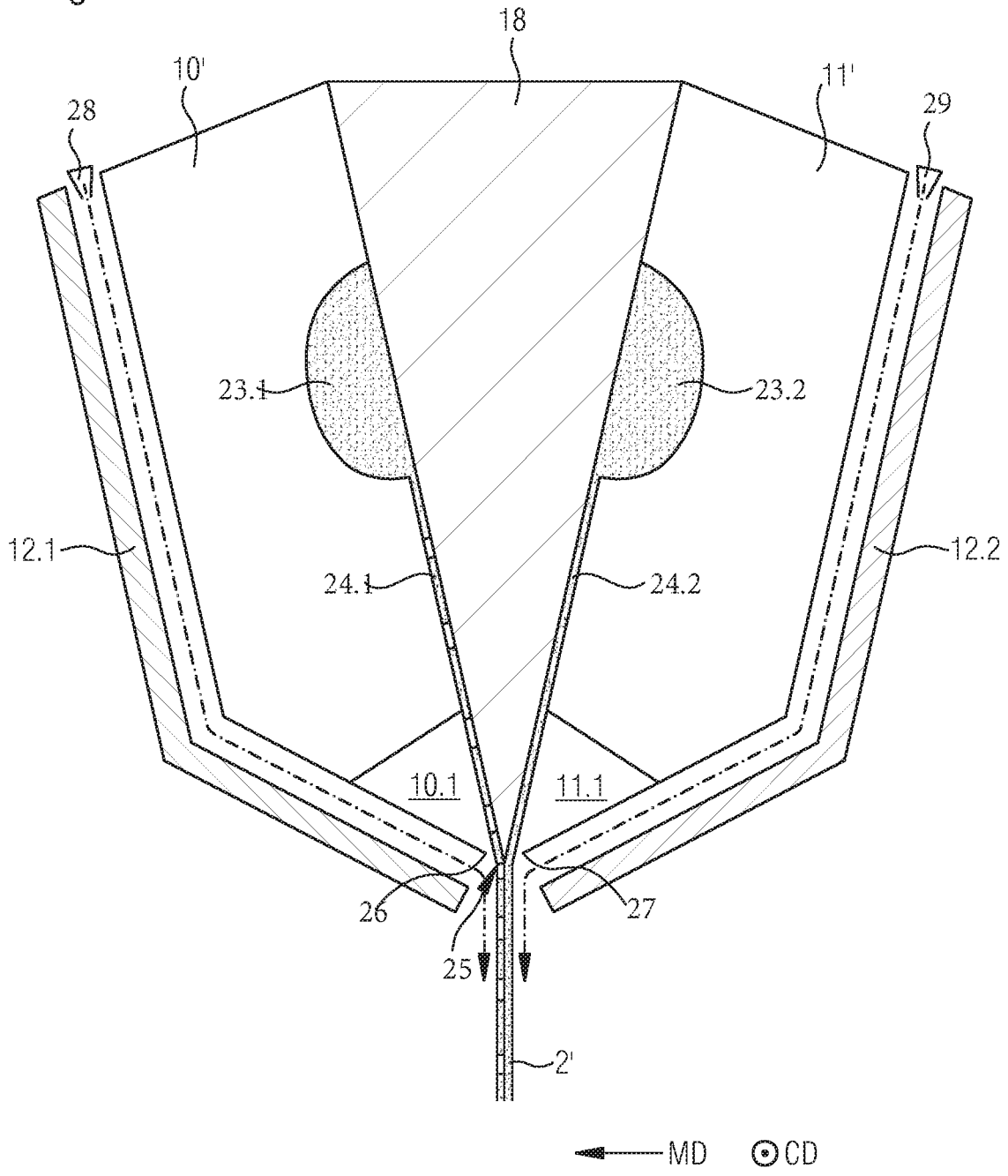

FIG. 11 shows an embodiment of an application head 1 according to the invention for generating a multilayered free falling curtain 2'.

Application head 1 of FIG. 11 differs from the application head shown in FIG. 8 basically in that the housing block has, in addition to a front and rear housing block part 10', 11', a housing block middle part 18, and also two cross distribution chambers 23.1 and 23.2 are provided with respective nozzle gap 24.1, 24.2, which meet at exit opening 25 to form a two-layered free falling curtain 2'. The application of medium to two separation edges 26, 27 and the thermal insulation of housing block 10', 11', 18 is designed similar to the embodiment of FIG. 8, namely, application of rinsing medium 13 provided by first rinsing device 28 to first separation edge 26 and application of rinsing medium 14 provided by second rinsing device 29 to second separation edge 27, the two rinsing media 13, 14 being channeled from the top part of housing block 10', 11', 18 in the gap between exterior cladding 12.1 or 12.2 in a flow direction running from the top to the bottom.

The invention claimed is:

1. A curtain application unit for applying a liquid or pasty application medium to at least one surface of a moving material web or fibrous web, the curtain application unit comprising:

an application head having a width, an exterior cladding, a nozzle gap for guiding the application medium and at least one separation edge extending over said width of said application head, said at least one separation edge configured to permit the application medium from said nozzle gap to exit said application head at said separation edge as a free falling curtain;

at least one rinsing supply disposed within said application head between said exterior cladding and said nozzle gap for applying a flowing gaseous rinsing medium to said at least one separation edge; and at least one blocking air nozzle configured to generate an air shield for keeping air movements of ambient air away from said curtain, said air shield having an air flow direction with at least one of a component pointing away from said application head or a component pointing away from the material web.

2. The curtain application unit according to claim 1, wherein said application head includes a housing block, a cross distribution chamber disposed in said housing block, and a thermally insulating layer surrounding at least a portion of said housing block and coming into contact with the surroundings.

3. The curtain application unit according to claim 2, wherein said housing block is made of a metallic material.

4. The curtain application unit according to claim 2, wherein said thermally insulating layer thermally decouples at least a portion of said exterior cladding from said housing block.

5. The curtain application unit according to claim 1, wherein said at least one blocking air nozzle is disposed at least one of before or after said application head in a direction of travel of the material web.

6. The curtain application unit according to claim 5, wherein said at least one blocking air nozzle and said application head are spaced apart by a distance of less than 100 cm.

7. The curtain application unit according to claim 5, wherein said at least one blocking air nozzle and said application head are spaced apart by a distance of less than 50 cm.

8. The curtain application unit according to claim 5, wherein said at least one blocking air nozzle and said application head are spaced apart by a distance of between 20 cm and 50 cm.

9. The curtain application unit according to claim 5, wherein said rinsing supply and said at least one blocking air nozzle are configured to be connected to a common air supply.

10. The curtain application unit according to claim 1, wherein at least one of the gaseous rinsing medium or the application medium has an adjusting temperature.

11. The curtain application unit according to claim 10, wherein the temperature of the rinsing medium is in a range of 0.4 times to 1.5 times the temperature of at least one of the surroundings or the application medium.

12. The curtain application unit according to claim 1, which further comprises a dehumidifier for reducing a moisture content of the rinsing medium.

13. A method for coating at least one surface of a moving material web or fibrous web with at least one liquid or pasty application medium, the method comprising the following steps:

providing a curtain application unit including an application head having a width, an exterior cladding, a nozzle gap for guiding the application medium and at least one separation edge extending over the width of the application head;

using the application head to emit the application medium from the nozzle gap past the at least one separation edge as a free falling single or multilayered curtain impinging on the material web;

using at least one rinsing supply disposed within the application head between the exterior cladding and the nozzle gap to apply a flowing gaseous rinsing medium to a region of the at least one separation edge; and using at least one blocking air nozzle to generate an air shield at a velocity of between 15 m/s and 60 m/s for keeping air movements of ambient air away from the single or multilayered curtain.

14. The method according to claim 13, which further comprises carrying out the emitting step by applying the application medium at a flow rate of less than 10 l/min*m.

15. The method according to claim 13, which further comprises carrying out the emitting step by applying the application medium at a flow rate of less than 6 l/min*m.

16. The method according to claim 13, which further comprises carrying out the emitting step by applying the application medium at a flow rate of between 2 l/min*m and 5 l/min*m.

17. The method according to claim 13, which further comprises setting a relative humidity of the rinsing medium to be less than 100 RH %.

18. The method according to claim 13, which further comprises setting an outflow velocity of the rinsing medium to be between 6 m/min and 40 m/min.

19. The method according to claim 13, which further comprises setting an outflow velocity of the rinsing medium to be between 12 m/min and 20 m/min.

20. The method according to claim 13, which further comprises setting an exit velocity of the application medium from the application head to be between 10 m/min and 100 m/min.

21. The method according to claim 13, which further comprises setting an exit velocity of the application medium from the application head to be between 16 m/min and 66 m/min.

22. The method according to claim 13, which further comprises carrying out the step of generating the air shield by using between 2.4 $m^3$/min/m and 12 $m^3$/min/m of air.

* * * * *